US011965678B2

(12) United States Patent
Kamei

(10) Patent No.: US 11,965,678 B2
(45) Date of Patent: Apr. 23, 2024

(54) ROTARY COMPRESSOR

(71) Applicant: DAIKIN INDUSTRIES, LTD., Osaka (JP)

(72) Inventor: Shota Kamei, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/138,898

(22) Filed: Apr. 25, 2023

(65) Prior Publication Data

US 2023/0258370 A1 Aug. 17, 2023

Related U.S. Application Data

(63) Continuation of application No. PCT/JP2021/040122, filed on Oct. 29, 2021.

(30) Foreign Application Priority Data

Oct. 30, 2020 (JP) ..... 2020-182485

(51) Int. Cl.
*F25B 1/04* (2006.01)
*F25B 31/00* (2006.01)
*F25B 41/40* (2021.01)

(52) U.S. Cl.
CPC ..... *F25B 1/04* (2013.01); *F25B 31/002* (2013.01); *F25B 41/40* (2021.01)

(58) Field of Classification Search
CPC ..... F25B 1/04; F25B 41/40; F25B 31/002; F25B 43/006; F25B 2400/03; F25B 2500/28
See application file for complete search history.

(56) References Cited

U.S. PATENT DOCUMENTS

2012/0308425 A1 12/2012 Morishita
2017/0218957 A1* 8/2017 Yamashita ..... F04C 28/28
2021/0340981 A1 11/2021 Okamoto et al.

FOREIGN PATENT DOCUMENTS

CN 205013244 U 3/2016
EP 2 192 303 A1 6/2010
(Continued)

OTHER PUBLICATIONS

Pdf is translation of foreign reference JP2001263282-A (Year: 2001).*
(Continued)

*Primary Examiner* — Henry T Crenshaw
*Assistant Examiner* — Kamran Tavakoldavani
(74) *Attorney, Agent, or Firm* — Global IP Counselors, LLP

(57) ABSTRACT

A rotary compressor includes a casing, a compression mechanism housed in the casing and having a suction port, a joint pipe fixed to the casing and formed into a cylindrical shape, a suction pipe arranged inside the joint pipe and communicating with the suction port, and an accumulator including an outlet pipe connected to an inlet end of the suction pipe. A large diameter portion formed on an inlet side of the suction pipe is fixed to an inner peripheral surface of the joint pipe, and a small diameter portion formed on an outlet side of the suction pipe has a smaller outside diameter than the large diameter portion. The joint pipe is made of an iron-based material. A clearance is formed between an outer peripheral surface of the small diameter portion of the suction pipe and the inner peripheral surface of the joint pipe.

20 Claims, 5 Drawing Sheets

(56) References Cited

FOREIGN PATENT DOCUMENTS

| | | | | | |
|---|---|---|---|---|---|
| EP | 3 051 131 | A1 | | 8/2016 | |
| JP | 2001-263282 | A | | 9/2001 | |
| JP | 2001263282 | A | * | 9/2001 | |
| JP | 2009-62876 | A | | 3/2009 | |
| JP | 2009062876 | A | * | 3/2009 | ..... F04B 39/121 |
| JP | 2011-196297 | A | | 10/2011 | |
| JP | 2011196297 | A | * | 10/2011 | |
| JP | 2012-251445 | A | | 12/2012 | |
| JP | 2020-70748 | A | | 5/2020 | |
| WO | 2016/039042 | A1 | | 3/2016 | |
| WO | 2020/067194 | A1 | | 4/2020 | |

OTHER PUBLICATIONS

Pdf is translation of foreign reference JP-2009062876-A (Year: 2009).*

Pdf is translation of foreign reference JP-2011196297-A (Year: 2011).*

International Preliminary Report of corresponding PCT Application No. PCT/JP2021/040122 dated May 11, 2023.

International Search Report of corresponding PCT Application No. PCT/JP2021/040122 dated Oct. 29, 2021.

European Search Report of corresponding EP Application No. 21 88 6407.2 dated Jan. 8, 2024.

* cited by examiner

ROTARY COMPRESSOR

CROSS-REFERENCE TO RELATED APPLICATIONS

This is a continuation of International Application No. PCT/JP2021/040122 filed on Oct. 29, 2021, which claims priority to Japanese Patent Application No. 2020-182485, filed on Oct. 30, 2020. The entire disclosures of these applications are incorporated by reference herein.

BACKGROUND

Technical Field

The present disclosure relates to a rotary compressor.

Background Art

There has been known a compressor for use in, for example, an air conditioner in the art. Japanese Unexamined Patent Publication No. 2020-70748 discloses a vertical hermetic compressor. This compressor includes a casing in which a compression mechanism is housed and which is connected to a joint pipe.

An accumulator is connected to an upstream portion of the compressor. The accumulator includes a closed container and an outlet pipe through which a refrigerant flows out of the closed container. The outlet pipe is connected to the compression mechanism via a suction pipe. The suction pipe is arranged inside the joint pipe to connect the closed container of the accumulator and the compression mechanism together.

SUMMARY

A first aspect of the present disclosure is directed to a rotary compressor. The rotary compressor includes a casing, a compression mechanism housed in the casing and having a suction port, a joint pipe fixed to the casing and formed into a cylindrical shape, a suction pipe arranged inside the joint pipe and communicating with the suction port of the compression mechanism, and an accumulator including an outlet pipe connected to an inlet end of the suction pipe. The suction pipe has a large diameter portion formed on an inlet side of the suction pipe and fixed to an inner peripheral surface of the joint pipe, and a small diameter portion formed on an outlet side of the suction pipe and having a smaller outside diameter than the large diameter portion. The joint pipe is made of an iron-based material. A clearance is formed between an outer peripheral surface of the small diameter portion of the suction pipe and the inner peripheral surface of the joint pipe.

DETAILED DESCRIPTION OF EMBODIMENT(S)

An embodiment of the present disclosure will be described below with reference to the drawings. The following embodiment is merely an exemplary one in nature, and is not intended to limit the scope, applications, or use of the present invention.

Embodiment

An embodiment will be described below.

Figure 1:
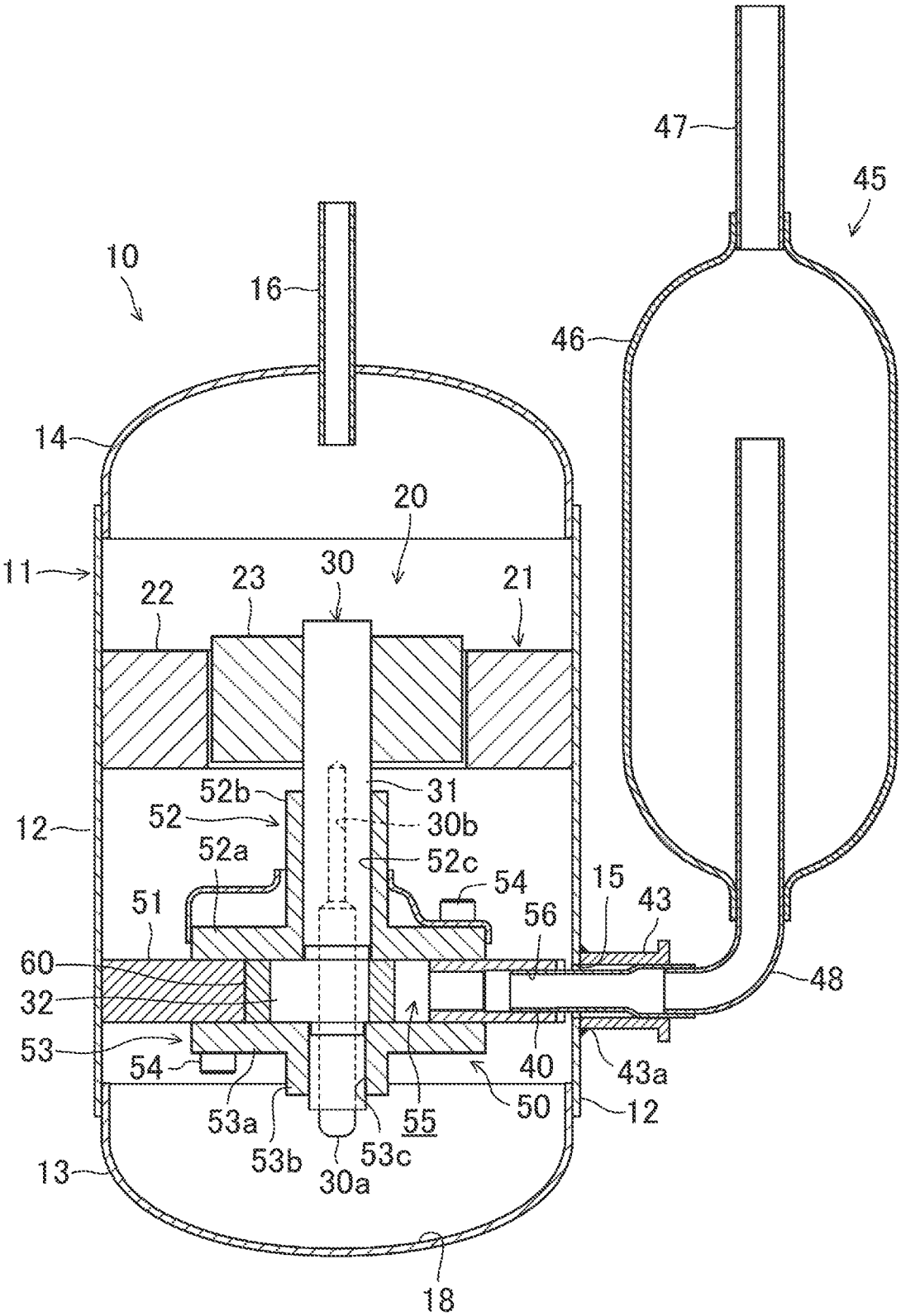
FIG. 1 is a vertical sectional view illustrating a configuration of a rotary compressor according to an embodiment.

As shown in FIG. 1, a compressor (10) according to the present embodiment is a hermetic rotary compressor. The compressor (10) is connected to a refrigerant circuit (not shown) filled with a refrigerant. In the refrigerant circuit, a vapor compression refrigeration cycle is performed. Specifically, in the refrigerant circuit, the refrigerant compressed by the compressor (10) condenses in a condenser. The refrigerant that has condensed is decompressed at an expansion valve, evaporates in an evaporator, and is sucked into the compressor (10).

Configuration of Compressor

The compressor (10) includes a casing (11), a compression mechanism (50), and a drive mechanism (20). The compression mechanism (50) and the drive mechanism (20) are housed inside the casing (11). The drive mechanism (20) drives the compression mechanism (50).

Casing

The casing (11) is configured as a vertically long cylindrical closed container. The casing (11) includes a barrel (12), a lower end plate (13), and an upper end plate (14). The barrel (12) is in the shape of a cylinder extending in a top-to-bottom direction (axial direction). Both ends of the barrel (12) in the top-to-bottom direction are open. The lower end plate (13) is fixed to the lower end of the barrel (12). The upper end plate (14) is fixed to the upper end of the barrel (12).

A suction pipe (40) passes through, and is fixed to, a lower portion of the barrel (12). A discharge pipe (16) passes through, and is fixed to, the upper end plate (14). A detailed configuration of the suction pipe (40) will be described later.

The casing (11) has, at its bottom, a reservoir (18). The reservoir (18) stores oil (refrigerating machine oil) for lubricating the compression mechanism (50) and sliding components of the drive shaft (30) to be described later. The reservoir (18) is formed by the lower end plate (13) and the inner wall of the lower portion of the barrel (12).

Drive Mechanism

The drive mechanism (20) includes an electric motor (21) and a drive shaft (30). The drive shaft (30) is coupled to the electric motor (21).

Electric Motor

The electric motor (21) is arranged above the compression mechanism (50). The electric motor (21) includes a stator (22) and a rotor (23).

The stator (22) is fixed to the inner peripheral surface of the barrel (12) of the casing (11). The rotor (23) passes through the inside of the stator (22) in the top-to-bottom direction. The drive shaft (30) is fixed inside a portion of the rotor (23) around the axis thereof. When the electric motor (21) is energized, the drive shaft (30) is rotationally driven together with the rotor (23).

Drive Shaft

The drive shaft (30) is located on the axis of the barrel (12) of the casing (11). An oil supply pump (30*a*) is attached to the lower end of the drive shaft (30). The oil supply pump (30*a*) transports the oil stored in the reservoir (18). The transported oil is supplied through an oil passage (30*b*) inside the drive shaft (30) to the compression mechanism (50) and the sliding components of the drive shaft (30).

The drive shaft (30) has a main shaft portion (31) and an eccentric portion (32). The eccentric portion (32) is decentered with respect to the center of rotation of the main shaft portion (31). An upper portion of the main shaft portion (31) is fixed to the rotor (23) of the electric motor (21). The eccentric portion (32) has an axis decentered by a predetermined distance with respect to the axis of the main shaft portion (31).

A portion of the main shaft portion (31) of the drive shaft (30) above the eccentric portion (32) is located inside a front through bore (52*c*) of a front head (52) to be described later, and is thus rotatably supported. A portion of the main shaft portion (31) of the drive shaft (30) below the eccentric portion (32) is located inside a rear through bore (53*c*) of a rear head (53), and is thus rotatably supported.

Compression Mechanism

The compression mechanism (50) is housed in the casing (11), and is arranged below the electric motor (21). The compression mechanism (50) includes a cylinder (51), the front head (52), the rear head (53), and a piston (60). The cylinder (51), the front head (52), and the rear head (53) are integrated together via a fastening member (54).

The cylinder (51) is a tubular member that covers the outer periphery of the eccentric portion (32). The cylinder (51) is fixed to the inner peripheral surface of the lower portion of the barrel (12) of the casing (11). The cylinder (51) has a flat and substantially annular shape.

A circular compression chamber (55) is formed in a central portion of the cylinder (51). The cylinder (51) has a suction port (56) extending in the radial direction. The outlet end of the suction port (56) communicates with the compression chamber (55). The suction pipe (40) is connected to the inlet end of the suction port (56).

The front head (52) is stacked on an upper end portion of the cylinder (51). The front head (52) is arranged to cover the internal space of the cylinder (51) from above. The front head (52) includes a front plate portion (52*a*) and a front protruding portion (52*b*).

The front plate portion (52*a*) is a flat and annular portion stacked on the cylinder (51). The front protruding portion (52*b*) is a tubular portion that protrudes upward from a central portion of the front plate portion (52*a*). The front through bore (52*c*) is formed in central portions of the front plate portion (52*a*) and front protruding portion (52*b*) such that the main shaft portion (31) of the drive shaft (30) passes therethrough. The front head (52) has a discharge passage (not shown) that passes through the front plate portion (52*a*) in the top-to-bottom direction (axial direction).

The rear head (53) is stacked on a lower end portion of the cylinder (51). The rear head (53) is arranged to cover the internal space of the cylinder (51) from below. The rear head (53) includes a rear plate portion (53*a*) and a rear protruding portion (53*b*).

The rear plate portion (53*a*) is a flat and annular portion stacked on the cylinder (51). The rear protruding portion (53*b*) is a tubular portion that protrudes downward from a central portion of the rear plate portion (53*a*). The rear through bore (53*c*) is formed in central portions of the rear plate portion (53*a*) and rear protruding portion (53*b*) such that the main shaft portion (31) of the drive shaft (30) passes therethrough.

The piston (60) is housed inside the cylinder (51). The cylinder (51) and the piston (60) form the compression chamber (55). The piston (60) has a perfect circular and annular shape. The eccentric portion (32) in the shape of a cylindrical column is fitted into the piston (60). The inside of the compression chamber (55) is partitioned into a low-pressure chamber and a high-pressure chamber by a blade (not shown). The compression mechanism (50) of the present embodiment is a so-called swing piston compression mechanism (50).

Operation of Compressor

The piston (60) rotates eccentrically in the compression chamber (55) together with the rotational driving of the drive shaft (30). When the volume of the low-pressure chamber increases gradually with the eccentric rotation of the piston (60), the refrigerant flowing through the suction pipe (40) is sucked through the suction port (56) into the low-pressure chamber. Then, when the low-pressure chamber is disconnected from the suction port (56), the disconnected space constitutes the high-pressure chamber.

Further eccentric rotation of the piston (60) gradually reduces the volume of the high-pressure chamber, resulting in an increase in the internal pressure of the high-pressure chamber. The internal pressure of the high-pressure chamber exceeding a predetermined pressure causes a reed valve (not shown) to open. Thus, the refrigerant in the high-pressure chamber flows out of the compression mechanism (50) through the discharge passage.

The high-pressure refrigerant flows upward through the internal space of the casing (11), and passes through a core cut (not shown) of the electric motor (21) or any other passage. The high-pressure refrigerant that has flowed out upward of the electric motor (21) is sent through the discharge pipe (16) to the refrigerant circuit.

Configuration of Accumulator

An accumulator (45) is connected to the upstream side of the compressor (10). The accumulator (45) temporarily stores the refrigerant that is yet to be sucked into the compressor (10), and separates a liquid refrigerant contained in a gas refrigerant into gas and liquid.

The accumulator (45) includes a closed container (46), an inlet pipe (47), and an outlet pipe (48). The inlet pipe (47) allows the refrigerant to flow into the closed container (46). The outlet pipe (48) allows the refrigerant to flow out of the closed container (46).

The closed container (46) is configured as a vertically long cylindrical member. The inlet pipe (47) is connected to an upper portion of the closed container (46). A lower end portion of the inlet pipe (47) opens near an upper portion of the internal space of the closed container (46).

The outlet pipe (48) is connected to a lower portion of the closed container (46). The outlet pipe (48) is made of an iron-based material (e.g., SPCC or SPCD). The outlet pipe (48) extends upward through the closed container (46). An upper end portion of the outlet pipe (48) opens near the upper portion of the internal space of the closed container (46). The outlet pipe (48) extends downward from the lower end of the closed container (46), and is then bent toward the suction pipe (40) of the compressor (10). A lower end portion of the outlet pipe (48) is connected to the inlet end of the suction pipe (40).

Configuration of Suction Pipe and Its Surroundings

Figure 2:
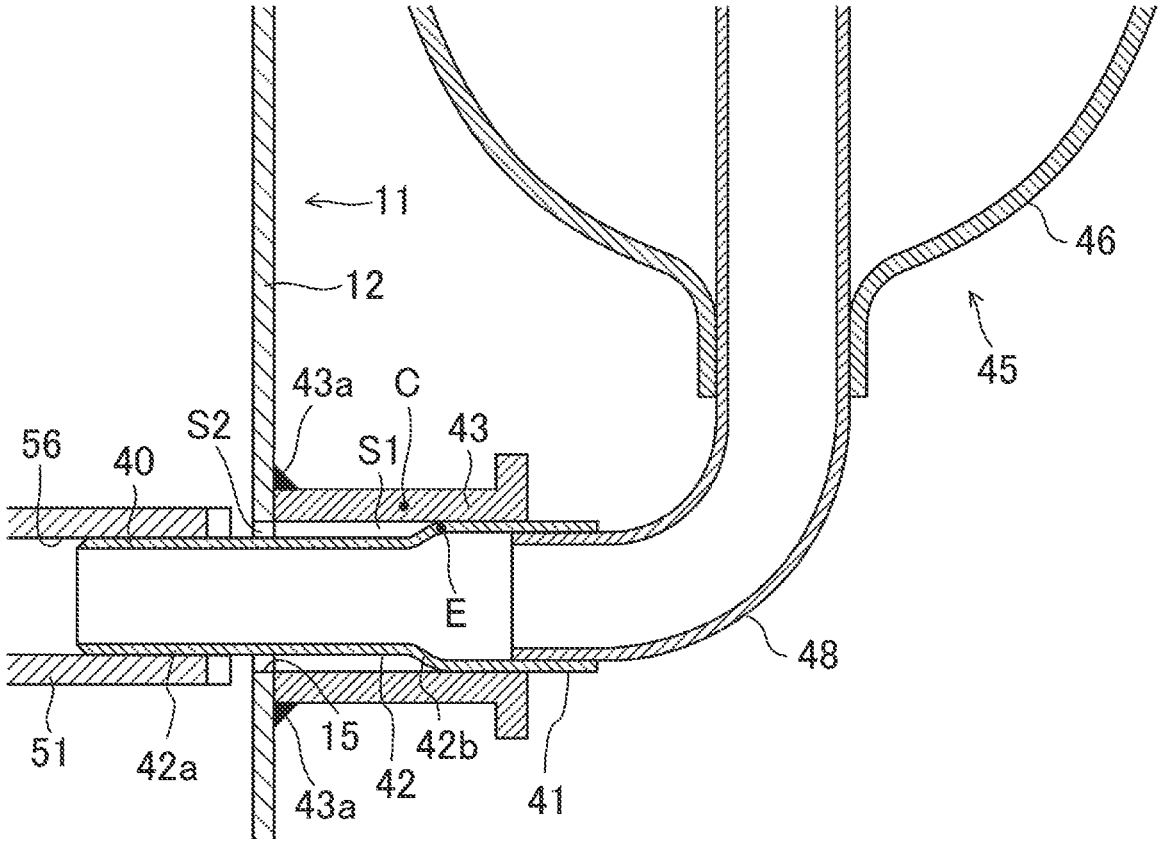
FIG. 2 is a vertical sectional view illustrating a suction pipe and its surroundings in an enlarged manner.

As shown in FIG. 2, the suction pipe (40) communicates with the suction port (56) of the cylinder (51), and is arranged inside the joint pipe (43).

Joint Pipe

The joint pipe (43) is fixed to a through hole (15) of the casing (11). The inner peripheral surface of the joint pipe (43) and the surface of the through hole (15) of the casing (11) are generally flush with each other. In other words, the inner peripheral surface of the joint pipe (43) is continuous with the surface of the through hole (15) of the casing (11). The through hole (15) of the casing (11) is formed in a lower portion of the barrel (12) of the casing (11). The through hole (15) of the casing (11) is positioned to face the suction port (56). In other words, the joint pipe (43) is arranged to face the suction port (56) of the cylinder (51).

The joint pipe (43) is made of an iron-based material (e.g., SPCC or SPCD). The joint pipe (43) is a cylindrical member. The joint pipe (43) extends from the barrel (12) of the casing (11) toward the outside of the casing (11). The thickness of the joint pipe (43) is greater than the thickness of the casing (11). The inside diameter of the joint pipe (43) is uniform throughout the axial length thereof.

The joint pipe (43) is fixed with its front end in contact with the barrel (12) of the casing (11). Specifically, the joint pipe (43) is welded to the barrel (12) of the casing (11) so as to be fixed. The joint pipe (43) has a weld (43*a*). The weld (43*a*) is formed all around the outer edge of a portion of the joint pipe (43) near the casing (11).

Suction Pipe

The suction pipe (40) extends through the inside of the joint pipe (43) to the outside of the casing (11). The suction pipe (40) is made of an iron-based material (e.g., SPCC or SPCD). The suction pipe (40) is a cylindrical member. The suction pipe (40) has a large diameter portion (41) and a small diameter portion (42).

The large diameter portion (41) is formed on the inlet side of the suction pipe (40). The large diameter portion (41) is fixed to the inner peripheral surface of the joint pipe (43). The outlet end of the outlet pipe (48) is fixed to the inner peripheral surface of the large diameter portion (41).

The small diameter portion (42) is formed on the outlet side of the suction pipe (40). The outside diameter of the small diameter portion (42) is smaller than the outside diameter of the large diameter portion (41). The small diameter portion (42) includes a body portion (42*a*) and a stepped portion (42*b*). The body portion (42*a*) is provided near the outlet of the small diameter portion (42). The outlet end of the body portion (42*a*) is connected to the suction port (56) of the cylinder (51). The outside diameter of the body portion (42*a*) is smaller than the diameter of the through hole (15) of the casing (11). The body portion (42*a*) runs through the through hole (15) of the casing (11).

The stepped portion (42*b*) is provided at an intermediate portion of the suction pipe (40), and is continuous with the inlet end of the body portion (42*a*). The stepped portion (42*b*) is a portion that connects the body portion (42*a*) and the large diameter portion (41) together. The outside and inside diameters of the stepped portion (42*b*) increase gradually from the body portion (42*a*) toward the large diameter portion (41).

An end portion (E) of the stepped portion (42*b*) of the small diameter portion (42) on the inlet side is closer to the accumulator (45) than a middle portion (C) of the joint pipe (43) in the axial direction is. A first clearance (S1) is formed between the outer peripheral surface of the small diameter portion (42) and the inner peripheral surface of the joint pipe (43). The first clearance (S1) is continuously formed between the end of the joint pipe (43) near the casing (11) and the junction of the joint pipe (43) with the large diameter portion (41) of the suction pipe (40). In other words, the suction pipe (40) is not in contact with the joint pipe (43) between the end of the joint pipe (43) near the casing (11) and the junction of the joint pipe (43) with the suction pipe (40). The first clearance (S1) corresponds to a clearance of the present disclosure.

As described above, the first clearance (S1) is continuously formed between the outer peripheral surface of the small diameter portion (42) of the suction pipe (40) and the inner peripheral surface of the joint pipe (43). Thus, even if vibrations generated by the compression mechanism (50) propagate to the suction pipe (40), the small diameter portion (42) vibrates without being in contact with the joint pipe (43). This allows the small diameter portion (42) to attenuate vibrations.

An annular second clearance (S2) is formed between the body portion (42*a*) of the small diameter portion (42) and the through hole (15) of the casing (11). A space including the first clearance (S1) and the second clearance (S2) is formed between the junction of the small diameter portion (42) with the compression mechanism (50) and the large diameter portion (41). This space allows vibrations of the small diameter portion (42). Thus, the small diameter portion (42) can further attenuate vibrations.

In addition, since the end portion (E) of the small diameter portion (42) on the inlet side is closer to the accumulator (45) than the middle portion (C) of the joint pipe (43) in the axial direction is, the length of the small diameter portion (42) of the suction pipe (40) can be increased. Thus, the small diameter portion (42) still further attenuates vibrations.

Here, L1 represents the entire axial length of the suction pipe (40), and L2 represents the axial length of the small diameter portion (42) of the suction pipe (40). In the compressor (10) of the present embodiment, the length L2 is greater than or equal to 58% of the length L1 ($L2 \geq L1 \times 0.58$).

Since the joint pipe (43) is made of an iron-based material, the joint pipe (43) has higher rigidity. Thus, vibrations transferred from the compression mechanism (50) are isolated by the junction between the large diameter portion (41) of the suction pipe (40) and the joint pipe (43), thereby making it difficult to transmit the vibrations to the accumulator (45).

Furthermore, since the joint pipe (43) is connected through the weld (43*a*) to the casing (11), the joint pipe (43) has high rigidity. Thus, vibrations transferred from the compression mechanism (50) to the suction pipe (40) can be further isolated by the joint pipe (43).

Connection Method for Accumulator

Next, a method for connecting the accumulator (45) to the compression mechanism (50) will be described. The compressor (10) of the present embodiment is manufactured through connection of the accumulator (45) to the compression mechanism (50). In the connection method for the accumulator, a welding step, a press-fitting step, a fitting step, and a brazing step are sequentially performed.

The welding step is a step of fixing the joint pipe (43) to the casing (11). In the welding step, first, the joint pipe (43) is brought into contact with the barrel (12) of the casing (11) such that the surface of the through hole (15) of the casing (11) is flush with the inner peripheral surface of the joint pipe (43). Next, the joint pipe (43) brought into contact with the barrel (12) is welded to the casing (11). Thus, the weld (43*a*) is formed.

The press-fitting step is a step of press-fitting the suction pipe (40) into the compression mechanism (50). In the press-fitting step, first, the compression mechanism (50) is arranged such that the suction port (56) of the cylinder (51) of the compression mechanism (50) faces the joint pipe (43). Next, the suction pipe (40) is press-fitted into the suction port (56) of the cylinder (51) from the open side of the joint pipe (43).

At this time, the suction pipe (40) is press-fitted in its axial direction such that the first clearance (S1) is formed between the outer peripheral surface of the small diameter portion (42) of the suction pipe (40) and the inner peripheral surface of the joint pipe (43). Specifically, the suction pipe (40) is press-fitted such that the axial length of a portion of the suction pipe (40) facing the first clearance (S1) is equal to a predetermined length.

In the fitting step, the outlet pipe (48) of the accumulator (45) is fitted into an open-side end portion of the suction pipe (40).

In the brazing step, brazing is done between the outlet pipe (48) and the suction pipe (40) and between the suction pipe (40) and the joint pipe (43), thereby fixing them together.

First Experimental Example

Figure 3:
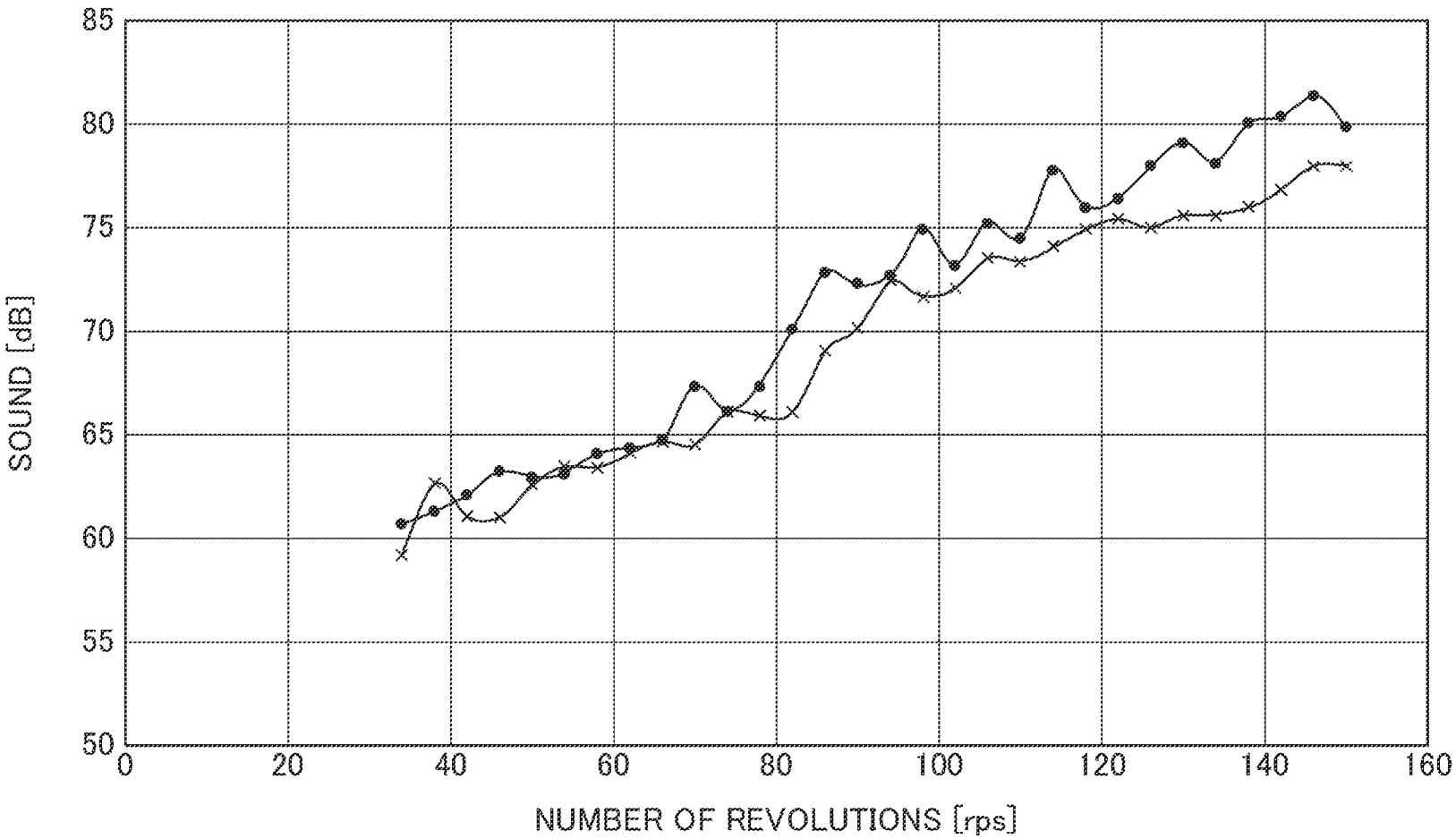
FIG. 3 is a graph showing the relationship between the number of revolutions of the rotary compressor and the intensity of sound.

FIG. 3 is a graph showing the relationship between the number of revolutions of the compressor (10) obtained by measurement and the intensity of sound.

The solid line that connects the dots in this figure together shows the result obtained when a compressor that has no first clearance (S1) between the outer peripheral surface of a small diameter portion (42) of a suction pipe (40) and the inner peripheral surface of a joint pipe (43) undergoes measurement. The solid line that connects the crosses in this figure together shows the result obtained when the compressor (10) of the present embodiment undergoes measurement. Specifically, this solid line shows the result obtained when the compressor (10) that has the first clearance (S1) between the outer peripheral surface of the small diameter portion (42) and the inner peripheral surface of the joint pipe (43) undergoes measurement. The joint pipe (43) in this experiment is made of an iron-based material.

This figure has showed that if the number of revolutions is greater than 70 rpm, the compressor (10) of the present embodiment produces sound with a lower intensity than the compressor that has no first clearance (S1) between the small diameter portion (42) and the joint pipe (43) does. This has showed that forming the first clearance (S1) between the outer peripheral surface of the small diameter portion (42) and the inner peripheral surface of the joint pipe (43) can reduce the vibrations transferred from the compression mechanism (50) to the accumulator (45).

Second Experimental Example

Figure 4:
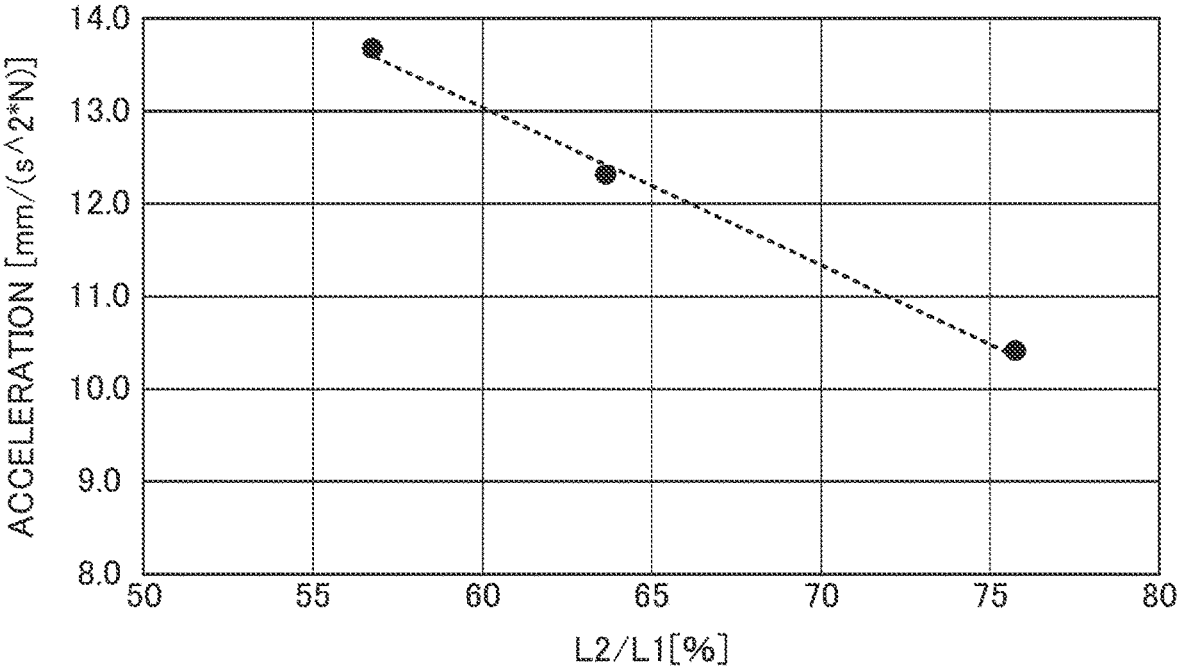
FIG. 4 is a graph showing the relationship between L2/L1 and the peak value of the acceleration of an accumulator.

FIG. 4 is a graph that obtained by a simulation and shows the relationship between the ratio L2/L1 and the peak value of the acceleration of an accumulator. Specifically, FIG. 4 is a graph plotting the peak value of the acceleration representing vibrations of the accumulator (45) when a force with a magnitude of 1 N is applied to the suction pipe (40). FIG. 4 plots the peak values of the acceleration of the accumulator (45) of the compressor (10) at ratios L2/L1 of 57%, 64%, and 76%.

This figure has showed that if the ratio L2/L1 is greater than or equal to 58%, the peak value of the acceleration of the accumulator (45) decreases with increasing ratio L2/L1. In other words, this figure has showed that as the axial length L2 of the small diameter portion (42) of the suction pipe (40) increases with respect to the entire axial length L1 of the suction pipe (40), vibrations of the accumulator (45) are reduced.

This has showed that if the axial length L2 of the small diameter portion (42) of the suction pipe (40) is greater than or equal to 58% of the entire axial length L1 of the suction pipe (40), vibrations of the accumulator (45) can be reduced.

Features of Embodiment

A feature (1) of the present embodiment is that the first clearance (S1) is formed between the outer peripheral surface of the small diameter portion (42) of the suction pipe (40) and the inner peripheral surface of the joint pipe (43). Thus, even if vibrations of the compression mechanism (50) are transferred to the suction pipe (40), the small diameter portion (42) vibrates without being in contact with the joint pipe (43). This allows the small diameter portion (42) to attenuate vibrations.

Here, a joint pipe (43) of a known compressor has been made of a copper-based material. The known joint pipe (43) with low rigidity has facilitated transmitting vibrations from the compression mechanism (50) through the suction pipe (40) to the joint pipe (43).

Since the joint pipe (43) of the present embodiment is made of an iron-based material, the rigidity of the joint pipe (43) is higher than that of a joint pipe made of a copper-based material. Thus, vibrations from the compression mechanism (50) can be isolated at the junction between the large diameter portion (41) of the suction pipe (40) and the joint pipe (43). As a result, vibrations transferred from the compression mechanism (50) to the accumulator (45) can be reduced.

In addition, the joint pipe (43) made of an iron-based material is less expensive than that made of a copper-based material.

A feature (2) of the present embodiment is that the first clearance (S1) is continuously formed from the end of the joint pipe (43) near the casing (11) to the junction of the joint pipe (43) with the suction pipe (40). This allows the small diameter portion (42) of the suction pipe (40) to vibrate without being hindered by the joint pipe (43), thus further attenuating vibrations.

A feature (3) of the present embodiment is that the end portion (E) of the small diameter portion (42) on the inlet side is closer to the accumulator (45) than the middle portion (C) of the joint pipe (43) in the axial direction is. This can increase the length of the small diameter portion (42) of the suction pipe (40), thus further attenuating vibrations.

A feature (4) of the present embodiment is that the joint pipe (43) has the weld (43*a*) welded to the casing (11). This can increase the rigidity of the joint between the joint pipe (43) and the casing (11). Thus, vibrations from the compression mechanism (50) can be further isolated by the joint pipe (43).

Here, in the known compressor, the joint pipe (43) and the casing (11) have been joined together by silver brazing. In the compressor (10) of the present embodiment, joining is performed by welding. This can reduce costs as compared to silver brazing.

A feature (5) of the present embodiment is that the thickness of the joint pipe (43) is greater than that of the casing (11). This can reduce the thermal deformation of the joint pipe (43) when the joint pipe (43) and the casing (11) are welded together.

A feature (6) of the present embodiment is that the outlet pipe (48) is made of an iron-based material. Here, in the known compressor, an outlet pipe has included a copper pipe and an iron pipe connected together. The outlet pipe (48) of the present embodiment is made of only an iron-based material. This can increase the rigidity of the outlet pipe (48). Thus, vibrations from the compression mechanism (50) can be further isolated by the outlet pipe (48). The outlet pipe (48) of the present embodiment can include a smaller number of components, and can be made of a material with lower cost. This can reduce costs.

A feature (7) of the present embodiment is that the axial length L2 of the small diameter portion (42) of the suction pipe (40) is greater than or equal to 58% of the entire axial length L1 of the suction pipe (40). The small diameter portion (42) that is somewhat long makes it easier for the small diameter portion (42) of the suction pipe (40) to attenuate vibrations from the compression mechanism (50).

A feature (8) of the present embodiment is directed to a method for manufacturing a rotary compressor including a casing (11), a compression mechanism (50) that is housed in the casing (11) and has a suction port (56), a joint pipe (43) fixed to the casing (11), a suction pipe (40) that is arranged inside the joint pipe (43) and communicates with the suction port (56) of the compression mechanism (50), and an accumulator (45) including an outlet pipe (48) connected to an inlet end of the suction pipe (40). The suction pipe (40) has a large diameter portion (41) formed on an inlet side of the suction pipe (40) and fixed to an inner peripheral surface of the joint pipe (43), and a small diameter portion (42) that is formed on an outlet side of the suction pipe (40) and has a smaller outside diameter than the large diameter portion (41). The casing (11) has a through hole (15). The diameter of the through hole (15) is larger than the outside diameter of the small diameter portion (42). The method includes: a welding step of welding the joint pipe (43) made of an iron-based material to the casing (11), and a press-fitting step of press-fitting the suction pipe (40) into the suction port (56) of the compression mechanism (50). In the press-fitting step, press-fitting is performed such that a first clearance (S1) is formed between an outer peripheral surface of the small diameter portion (42) of the suction pipe (40) and the inner peripheral surface of the joint pipe (43), and such that a second clearance (S2) is formed between the small diameter portion (42) and the through hole (15).

Thus, if vibrations of the compression mechanism (50) propagate to the suction pipe (40), the first and second clearances (S1) and (S2) allow the small diameter portion (42) to vibrate without being in contact with the joint pipe (43). This allows the small diameter portion (42) to attenuate vibrations of the compression mechanism (50).

In addition, the through hole (15) of the casing (11) having a diameter that is greater than the outside diameter of the small diameter portion (42) allows the second clearance (S2) to be formed. This facilitates alignment of the suction pipe (40) with the suction port (56) of the compression mechanism (50) in the press-fitting step.

Variations of Embodiment

First Variation

In the compressor (10) of the present embodiment, the joint pipe (43) may have its front end fitted into the through hole (15) of the casing (11). Also in the present variation, the first clearance (S1) is formed between the outer peripheral surface of the small diameter portion (42) of the suction pipe (40) and the inner peripheral surface of the joint pipe (43). Thus, advantages that are the same as, or similar to, those of the embodiment can be obtained.

Second Variation

Figure 5:
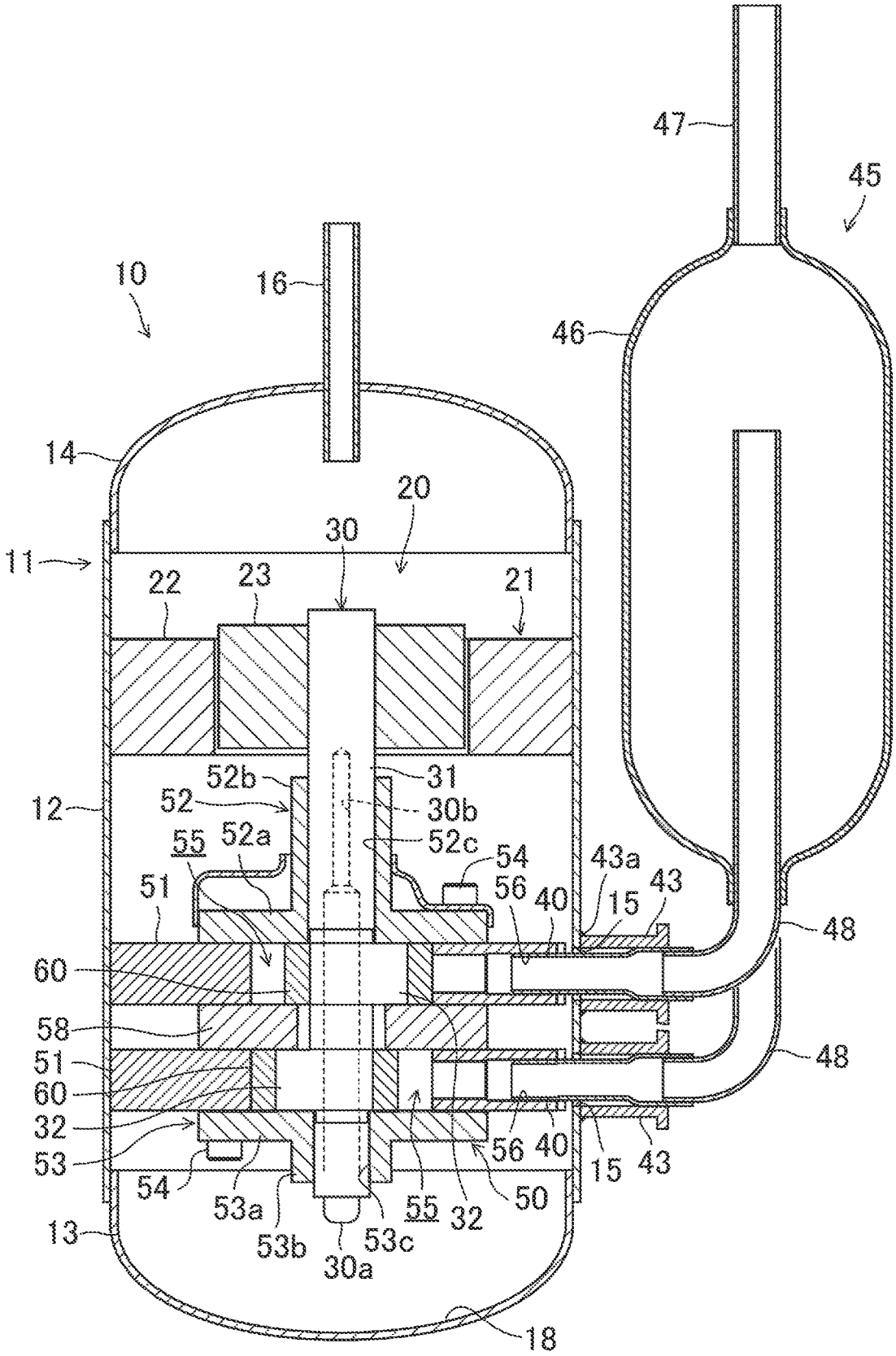
FIG. 5 is a vertical sectional view illustrating a configuration of a rotary compressor according to a second variation.

In the variation shown in FIG. 5, combinations of a cylinder (51) and a piston (60) are spaced apart from each other in the top-to-bottom direction (axial direction). Specifically, the compression mechanism (50) includes a front head (52), a front cylinder (51), a middle plate (58), a rear cylinder (51), and a rear head (53) that are stacked.

The pistons (60, 60) are housed in the front and rear cylinders (51, 51), respectively. The front and rear cylinders (51, 51) each have a suction port (56, 56) extending radially.

The drive shaft (30) includes two eccentric portions (32, 32) respectively associated with the front and rear pistons (60, 60). Each eccentric portion (32) is fitted into an associated one of the pistons (60).

The barrel (12) of the casing (11) has through holes (15, 15) each positioned to face an associated one of the front and rear suction ports (56, 56). Joint pipes (43, 43) are connected to the associated through holes (15) of the casing (11).

Suction pipes (40, 40) are connected to the suction ports (56, 56) of the front and rear cylinders (51, 51), respectively, and each extend through the inside of the associated joint pipe (43, 43) to the outside of the casing (11). Outlet pipes (48, 48) of the accumulator (45) are connected to the front and rear suction pipes (40, 40), respectively.

As can be seen, the present variation is intended for a two-cylinder compressor (10) including two cylinders (51, 51) and two pistons (60, 60). Also in the two-cylinder compressor (10), a first clearance (S1) is formed between the outer peripheral surface of a small diameter portion (42) of one of the suction pipes (40) and the inner peripheral surface of an associated one of the joint pipes (43). A space including the first clearance (S1) and a second clearance (S2) is formed between the junction of the small diameter portion (42) with the compression mechanism (50) and an associated one of large diameter portions (41).

Also in the present variation, vibrations transferred from the compression mechanism (50) to the accumulator (45) can be reduced just like the embodiment. In addition, the outlet pipes (48) made of only an iron-based material can further reduce the number of components, resulting in a further reduction in cost.

While the embodiment and variations thereof have been described above, it will be understood that various changes in form and details may be made without departing from the spirit and scope of the claims. The embodiments, the variations, and the other embodiments may be combined and replaced with each other without deteriorating intended functions of the present disclosure.

Other Embodiments

The foregoing embodiments may also be configured as follows.

The compression mechanism (50) of the compressor (10) of the foregoing embodiment is a swing piston compression mechanism. However, the compression mechanism (50) may be a rolling piston compression mechanism. This compression mechanism (50) has a compression chamber (55) partitioned by a vane separate from the piston (60) instead of by the blade of the embodiment.

As can be seen from the foregoing description, the present disclosure is useful for a rotary compressor.

The invention claimed is:

1. A rotary compressor comprising:

a casing;

a compression mechanism housed in the casing, the compression mechanism having a suction port;

a joint pipe fixed to the casing, the joint pipe being formed into a cylindrical shape;

a suction pipe arranged inside the joint pipe, the suction pipe communicating with the suction port of the compression mechanism; and an accumulator including an outlet pipe connected to an inlet end of the suction pipe, the suction pipe having a large diameter portion formed on an inlet side of the suction pipe, the large diameter portion being fixed to an inner peripheral surface of the joint pipe, and a small diameter portion formed on an outlet side of the suction pipe, the small diameter portion having a smaller outside diameter than the large diameter portion, the joint pipe being made of an iron-based material, a clearance being formed between an outer peripheral surface of the small diameter portion of the suction pipe and the inner peripheral surface of the joint pipe, and in a vertical sectional view, a total length of a width of an upper side of the clearance and a width of a lower side of the clearance being smaller than an inside diameter of the small diameter portion of the suction port.

2. The rotary compressor of claim 1, wherein a thickness of the joint pipe is greater than a thickness of the suction pipe.

3. The rotary compressor of claim 1, wherein an end portion of the small diameter portion on the inlet side is closer to the accumulator than a middle portion of the joint pipe in an axial direction.

4. The rotary compressor of claim 1, wherein the joint pipe has a weld welded to the casing.

5. The rotary compressor of claim 4, wherein a thickness of the joint pipe is greater than a thickness of the casing.

6. The rotary compressor of claim 1, wherein the outlet pipe is made of an iron-based material.

7. The rotary compressor of claim 1, wherein an axial length of the small diameter portion of the suction pipe is at least 58% of an entire axial length of the suction pipe.

8. The rotary compressor of claim 2, wherein an end portion of the small diameter portion on the inlet side is closer to the accumulator than a middle portion of the joint pipe in an axial direction.

9. The rotary compressor of claim 2, wherein the joint pipe has a weld welded to the casing.

10. The rotary compressor of claim 3, wherein the joint pipe has a weld welded to the casing.

11. The rotary compressor of claim 2, wherein the outlet pipe is made of an iron-based material.

12. The rotary compressor of claim 3, wherein the outlet pipe is made of an iron-based material.

13. The rotary compressor of claim 4, wherein the outlet pipe is made of an iron-based material.

14. The rotary compressor of claim 5, wherein the outlet pipe is made of an iron-based material.

15. The rotary compressor of claim 2, wherein an axial length of the small diameter portion of the suction pipe is at least 58% of an entire axial length of the suction pipe.

16. The rotary compressor of claim 3, wherein an axial length of the small diameter portion of the suction pipe is at least 58% of an entire axial length of the suction pipe.

17. The rotary compressor of claim 4, wherein an axial length of the small diameter portion of the suction pipe is at least 58% of an entire axial length of the suction pipe.

18. The rotary compressor of claim 5, wherein an axial length of the small diameter portion of the suction pipe is at least 58% of an entire axial length of the suction pipe.

19. The rotary compressor of claim 6, wherein an axial length of the small diameter portion of the suction pipe is at least 58% of an entire axial length of the suction pipe.

20. The rotary compressor of claim 8, wherein the joint pipe has a weld welded to the casing.

* * * * *